United States Patent [19]

Witte et al.

[11] 4,365,373

[45] Dec. 28, 1982

[54] PROCESS FOR THE DYEING AND FIXING OF KNITTED ARTICLES OF CLOTHING

[75] Inventors: Willi Witte, Gevelsberg; Wulf Böing, Hagen, both of Fed. Rep. of Germany

[73] Assignee: Proll & Lohmann Betriebs - GmbH, Hagen, Fed. Rep. of Germany

[21] Appl. No.: 191,473

[22] Filed: Sep. 26, 1980

[30] Foreign Application Priority Data

Oct. 4, 1979 [DE] Fed. Rep. of Germany ..... 2940267

[51] Int. Cl.[3] ..... D06B 3/30

[52] U.S. Cl. ..... 8/150; 223/76

[58] Field of Search ..... 8/149.1, 150; 68/3 R, 68/19, 20, 157, 158, 199; 223/60, 75, 76, 77; 198/651; 34/105

[56] References Cited

U.S. PATENT DOCUMENTS

| | | | |
|---|---|---|---|
| 1,504,731 | 8/1924 | Wigglesworth et al. | 223/76 X |
| 2,221,669 | 11/1940 | Brewin | 223/76 X |
| 3,032,383 | 5/1962 | Frenzel | 8/150 |
| 3,842,973 | 10/1974 | Rothert | 8/150 X |

*Primary Examiner*—Philip R. Coe

*Attorney, Agent, or Firm*—Martin A. Farber

[57] ABSTRACT

This invention relates to a method of dyeing and fixing knitted socks, stockings, panty hose or similar knitted articles of clothing of highly elastic material, preferably synthetic fibers. In this method, the articles of clothing are pulled onto flat forms and pass in succession through stations for dyeing, fixing and drying, as well as possibly preforming, rinsing and/or after-forming. In order to prevent deformations resulting from loads exerted on the knitted fabric, the articles of clothing travel, while lying approximately horizontal, through the individual treatment stations with their fibers extending in the longitudinal direction of the article of clothing. In the apparatus for the carrying out of the process, which has a plurality of flat forms onto which the articles of clothing to be treated are pulled and which, between a pulling-on and pulling-off station, are movable by a transportation device through the treatment stations, the card-shaped forms are inclined at most by an angle of 25° to the horizontal but are preferably arranged horizontally on the transporation device.

4 Claims, 5 Drawing Figures

PROCESS FOR THE DYEING AND FIXING OF KNITTED ARTICLES OF CLOTHING

The present invention relates to a process for the dyeing and fixing of knitted socks, stockings, panty hose or similar knitted articles of clothing of highly elastic material, preferably synthetic fibers, in which the articles of clothing are pulled onto flat forms and pass in succession through stations for dyeing, fixing and drying, as well as possibly preforming, rinsing and/or after-forming, and to an apparatus for the carrying out of this process.

In the known processes and apparatus of the above-mentioned type, the articles of clothing are pulled onto vertical forms. Due to this there is the disadvantage that the highly elastic knitted material of the articles of clothing is acted on in particular by liquids which drop down on the articles of clothing and that it accordingly yields. This yielding of the highly elastic material results from the identity of the direction of action of the downward flowing liquid with the lengthwise direction of the article of clothing so that impermissible deformations of the articles occur, which can only be partially counteracted by special shaping of the vertical forms and/or by a special after-forming process. By highly elastic material there is understood in this connection not only a knitted fabric of fibers of elastic properties, for instance, acrylic or Helanca yarn, but also a knitted fabric which is elastic as a result of the nature of its thread construction, such as, for instance, a so-called knitted "false-twist" consisting of fibers without elastic properties.

The object of the invention is to eliminate the disadvantages present in the known process and apparatus with respect to the deformation resulting from the load exerted on the knitted fabric in a simple manner by a further development both of the process and of the apparatus.

In accordance with the process of the invention the articles of clothing pass while lying approximately horizontal, through the individual treatment zones with their fibers extending in the longitudinal direction of the article of clothing.

By the approximately horizontal position of the fibers extending in the longitudinal direction of the article of clothing during the individual treatment stages the direction of action of the load, which in particular results from the downwardly dripping liquids extends approximately transverse to the length-wise direction of the fibers of the knitted fabric which extend in the longitudinal direction of the article of clothing so that it is primarily not the fibers of the greatest length which extend in the longitudinal direction of the article of clothing but rather the fibers of the knitted fabric which extend transverse thereto which take up the load, the fibers which extend transverse to the longitudinal direction of the article of clothing having only a short free knit length, for which reason the deformations are considerably less than in the case of the previously known vertical arrangement of the forms and thus of the articles of clothing. By the process of the invention, therefore, the deformations which result in particular from the downwardly draining liquids remain within the range of permissible values so that special aids or additional process steps such as after-forming step can be dispensed with.

The apparatus for carrying out of the process of the invention, in the same way as in the known apparatus, has treatment stations for dyeing, fixing and drying, as well as possibly for forming and rinsing, as well as a plurality of flat forms on which the articles of clothing to be treated are placed and which are movable between a pulling-on and a pulling-off station by a conveyor through the treatment stations.

The apparatus of the invention is characterized by the fact that the card-shaped forms are inclined at most by an angle of 25° to the horizontal and are preferably arranged lying horizontally on the conveyor.

This approximately horizontal arrangement of the forms on the transportation device automatically produces, upon the pulling on of the articles of clothing to be treated, an approximately horizontal course of the fibers of the knitted fabric which extend in the lengthwise direction of the article of clothing, regardless of whether the forms—in accordance with a further feature of the invention—are arranged on the conveyor with their cross section standing vertically or lying horizontally.

If the forms moved with horizontally lying cross section by the conveyor are arranged, in accordance with the invention, in the treatment stations at a vertical distance apart which lies within the order of magnitude of the thickness of the material of the forms, the individual forms can not only rest on each other but there also result such small spaces between the forms which are located one above the other that the fibers of the articles of clothing cannot be overstressed by elongation.

One embodiment of the apparatus of the invention as well as an alternative embodiment for the conveyor are shown diagrammatically in the drawings, in which.

Figure 1:
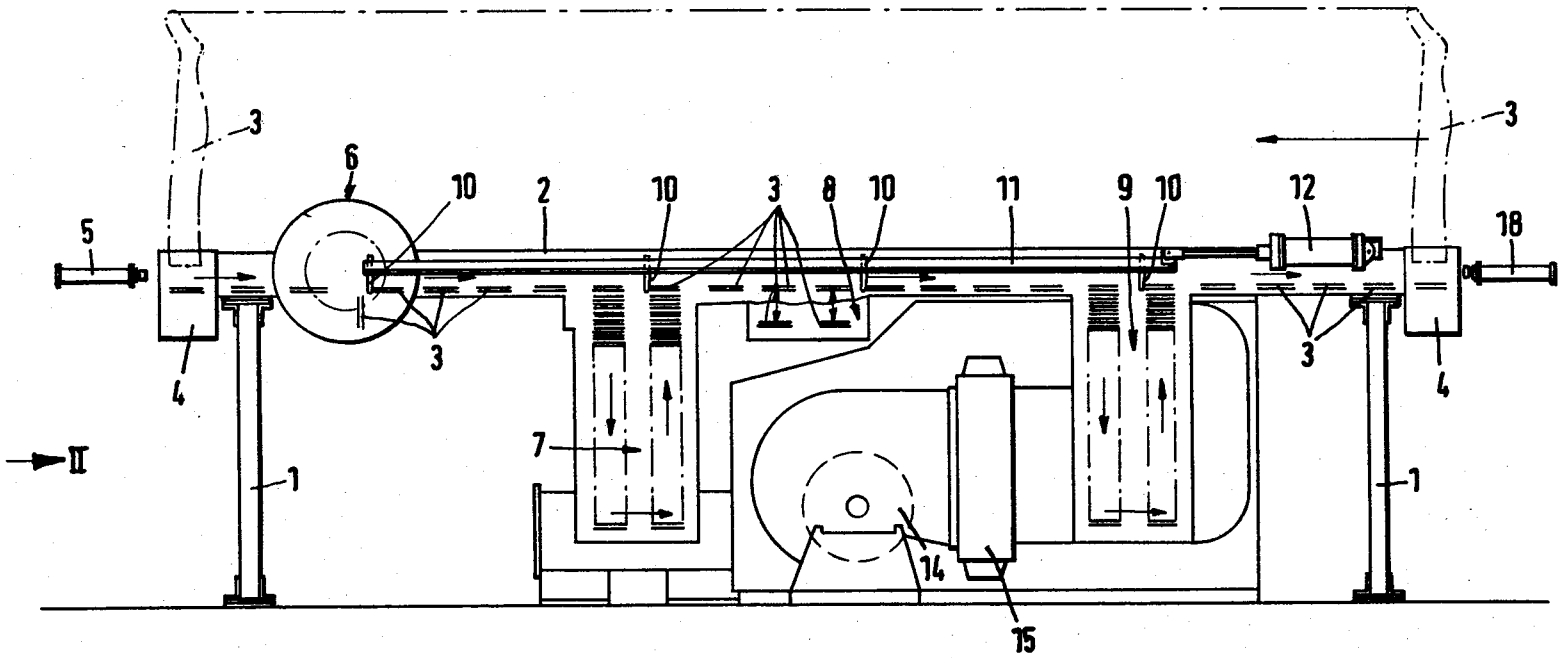
FIG. 1 is a side view of the entire apparatus.
Figure 2:
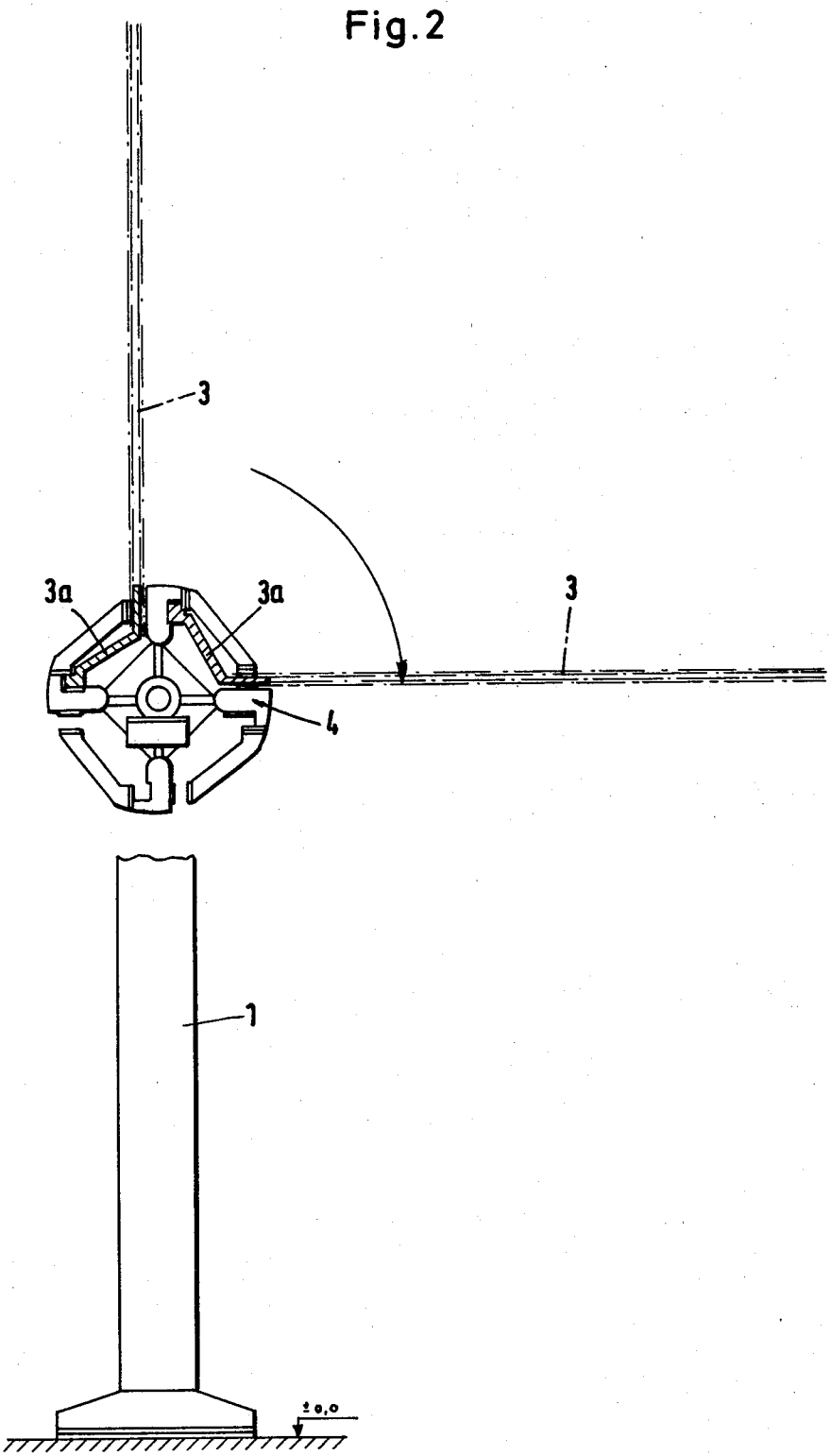
FIG. 2 is an end view of the apparatus seen in the direction indicated by the arrow II in FIG. 1.
Figure 3:
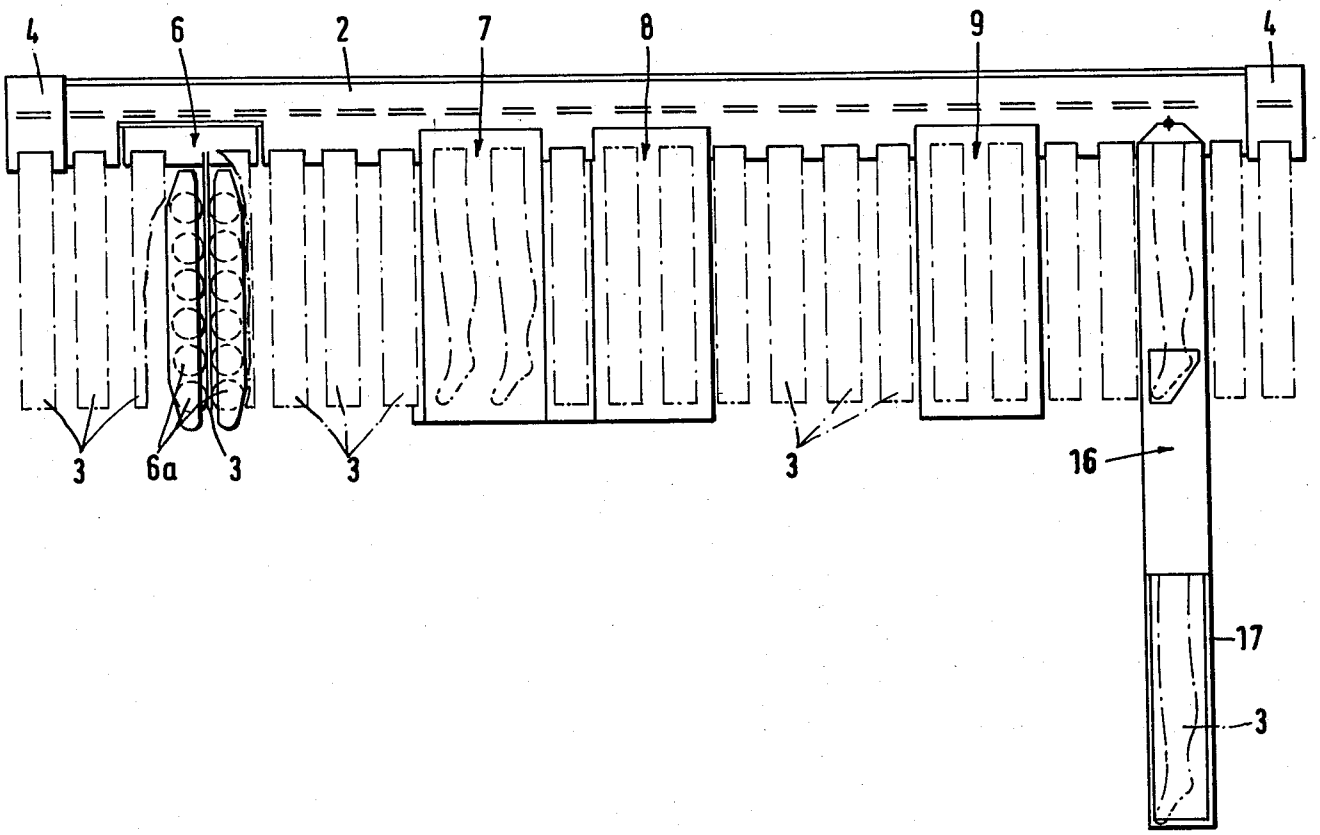
FIG. 3 is a top view of the apparatus of FIGS. 1 and 2.

The apparatus for the dyeing and fixing of knitted articles of clothing of highly elastic material, for instance socks, stockings or panty hose, comprises, in the embodiment shown in FIGS. 1 to 3, a machine frame which is formed of two vertical columns 1 and a horizontally extending frame 2. On this horizontal frame 2 there are moved a plurality of forms 3, each of which, in the case of the embodiment shown, has the shape of a woman's stocking and is formed, in accordance with FIG. 2, of two correspondingly shaped panels, for instance of aluminum sheet. These two panels of each form 3 are fastened to a common form holder 3*a*, as can be noted in cross section from FIG. 2.

On each of the two ends of the horizontally extending frame 2 there is provided a turret head 4, by means of which the forms 3 can be brought from a vertical position into a horizontal position or vice versa, as is shown in FIG. 2. In this way it is possible to move the forms on the one hand in horizontally lying position from the left end of the frame 2 through the treatment stations of the apparatus towards the right, and transfer them at the right-hand end by means of the turret head 4 into a vertical position and bring them back in this vertical position to the left-hand end of the frame 2 where they are again swung by 90° into the horizontal position by the turret head 4 which is arranged there, as indicated by the arrow in FIG. 2.

In the embodiment of the apparatus shown in FIGS. 1 to 4, the forms 3, which are not interconnected, are moved in guides of the frame 2 which have not been shown in detail in the drawing. The movement of the forms 3 is effected over a first part of the path by a compressed-air cylinder 5 which moves the individual forms intermittently from the turret head 4 arranged on the left end of the frame 2 up to a pulling-on station 6. In this pulling-on station 6 the individual forms 3 are brought for a brief time from the position in which they lie horizontally in cross section into a position in which each from 3 has its cross section vertical, as indicated in FIGS. 1 and 3. In this position, the empty form 3 is provided with an article of clothing which is to be treated. In the embodiment shown in FIG. 3 this is done by means of rollers 6*a* which pull the open end of the article of clothing over the form 3 which lies horizontally with its cross section extending vertically and bring it into the correct position on the form 3. Thereupon, the form 3 which is thus provided with an article of clothing to be treated is again swung into the horizontal position with its cross section horizontal, as can be noted particularly easily from FIG. 1.

From the pulling-on station 6, each form 3 provided with an article of clothing passes stepwise into a dyeing station 7, a rinsing station 8 and a drier 9. The transportation of the individual forms 3 between the pulling-on station 6 and the drier 9 is effected by means of drive flights or carriers 10 which are arranged swingable in one direction on a transport rod 11. The transport rod 11 is moved back and forth by an operating cylinder 12. When the transport rod 11 moves towards the left in FIG. 1, the flights 10 swing in a direction of rotation which is counterclockwise so that they slide over the forms 3 which lie to the left of them. On the other hand if the transport rod 11 is moved to the right in FIG. 1, the flights 10 grip behind the form 3 which in each case is located to the right of them and carry it along on their path of movement.

Figure 4:
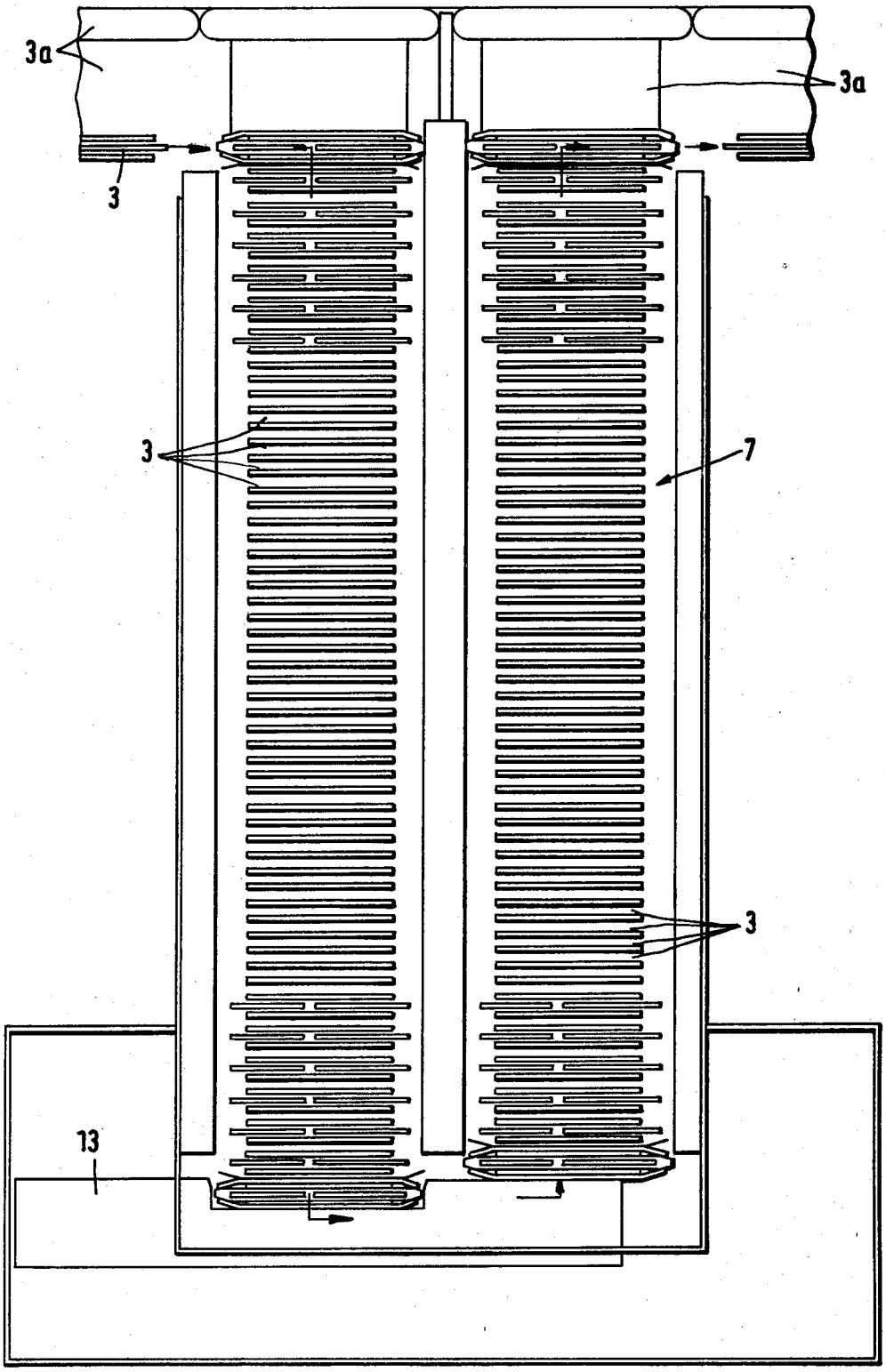
FIG. 4 is a side view, partially in section, of a dyeing station of the apparatus of FIGS. 1 to 3, shown on a larger scale.

In the dyeing station 7, which is shown on a larger scale in FIG. 4, the individual forms 3 pass into two shafts arranged vertically alongside of each other. In the left of the two shafts the forms 3 with the article of clothing stretched thereon travel stepwise downwardly until they are transferred as a last form, shown in FIG. 4, by a pusher 13 into the right-hand shaft. Within this right-hand shaft there takes place a stepwise movement of the forms 3 in the upward direction since the push member 13, in addition to carrying out a backward and forward motion also carries out a lifting motion which corresponds to the vertical size of a flat-lying form 3. In this way, upon each cycle of the transport device a form 3 enters into the left-hand shaft and at the same time a form 3 moves out of the right-hand shaft onto the transport path of the frame 2. Since the dyeing station 7 is filled with dye, the articles of clothing present on the forms 3 are subjected to a dyeing treatment during the period that each form remains in the dyeing station 7.

After a short path, the forms 3 which bear the dyed articles of clothing pass, in accordance with FIG. 1, into the rinsing station 8 in which excess particles of dye are rinsed off. For this purpose, the forms 3 which are present in the rinsing station 8 carry out a short lifting movement in the vertical direction, as indicated by the two arrows within the rinsing station 8 in FIG. 1.

From the rinsing station 8 the dyed articles of clothing which have been preferably rinsed with clear water enter into the drier 9. As indicated schematically in FIG. 1, the drier is provided with hot air by means of a blower 14. The hot air, which is circulated in a closed circuit, passes in this connection through a heat exchanger 15, which can be noted in FIG. 1.

From the drier 9 the articles of clothing, each of which is stretched on a form 3, finally pass into a pulling-off station 16 which can best be noted from the top view in FIG. 3. In this pulling-off station 16, a carriage 17 which moves back and forth effects a pulling-off of the dyed, washed and dried articles of clothing from the form 3 present at the time at the pulling-off station 16. While the completely treated article of clothing is fed to a subsequent packing operation stage, the form 3, which is now empty, passes into the turret head 4 which is present at the right-hand end of the frame 2. Here the form 3 is swung from the horizontally lying position into a vertical position, as can be noted in the right-hand part of FIG. 1. In this vertical position the empty forms 3 are transported by means of a compressed air cylinder 18, in the direction indicated by the arrow in FIG. 1, to the left-hand end of the frame 2 where they are again swung by 90° and provided in the pulling-on station 6 with an article of clothing which is to be treated.

Figure 5:
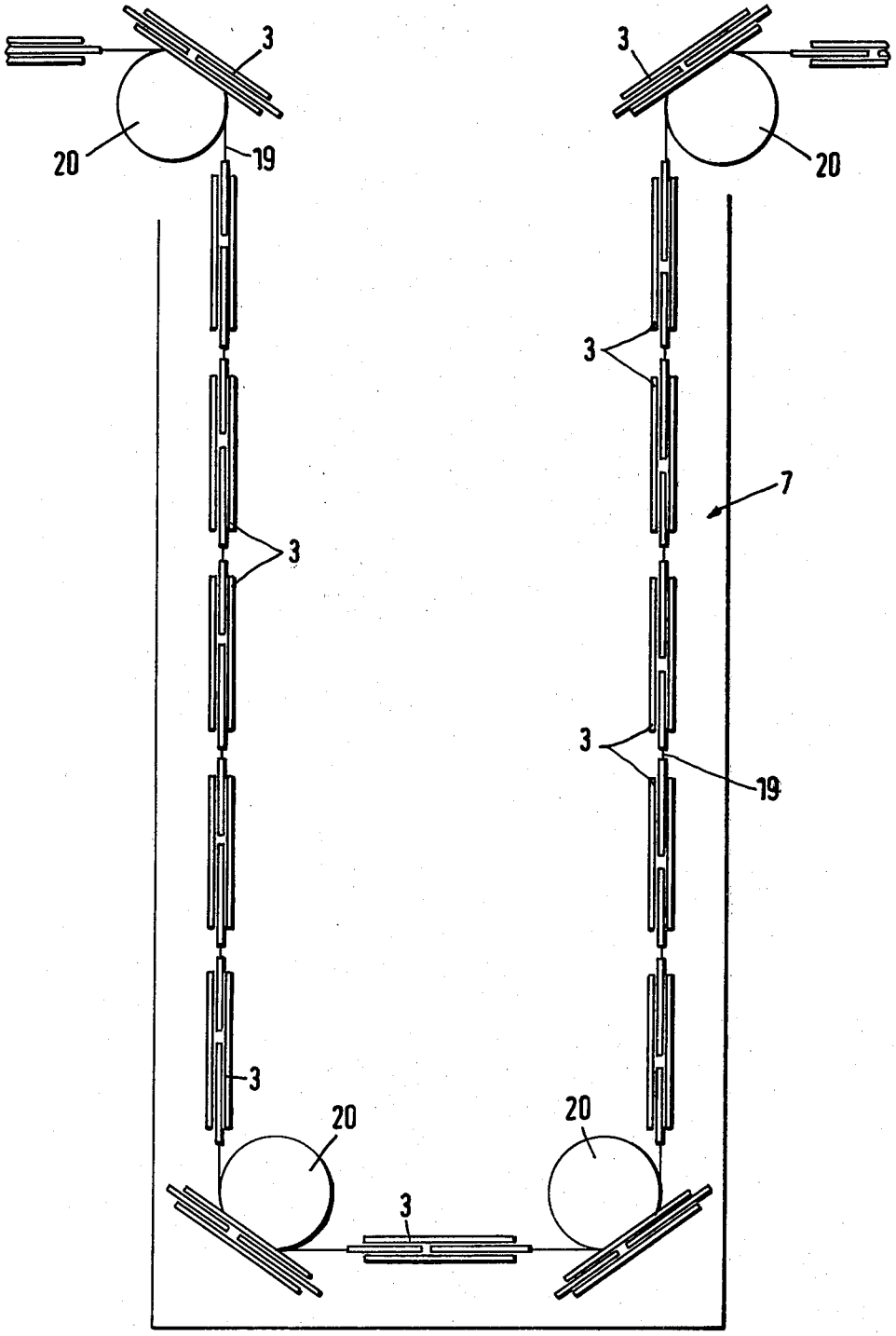
FIG. 5 is a dyeing station corresponding to FIG. 4 having an alternative embodiment of the conveyor device.

In the case of the alternative embodiment of the conveyor device shown in FIG. 5, the individual forms 3 are so arranged on a chain 19 that they lie spaced equally apart one behind the other and by a movement of this chain 19 pass through the individual treatment stations. In this case, four guide rollers 20 are arranged within the dyeing station 7 so that the forms 3 while lying horizontally nevertheless pass with vertically arranged cross section through the dyeing station 7.

Due to the horizontal position of the articles of clothing during their treatment in the apparatus described above, it is not the fibers which extend in the lengthwise direction of the article of clothing, but the fibers which lie in the transverse direction thereof which are subjected to load during the individual treatments, especially by downwardly draining dye and rinse liquids. Since these fibers which extend in the transverse direction of the article of clothing have a considerably shorter length than the fibers which lie in the longitudinal direction, deformations of the highly elastic material which are produced are considerably less than in the previously known processes in which the articles of clothing to be treated are guided, standing vertically, through the treatment stations. For this reason, special aids or additional process steps such as, for instance, after-forming operations, can be dispensed with in the case of the process described above. Further reduction of the load on the fibers is obtained from the arrangement, shown in FIG. 4, of the forms in the dyeing station since the maximum amount of the elongation is limited by the small distance between the superimposed forms.

We claim:

1. In a process for the continuous dyeing and fixing of articles of clothing having fibers and comprising knitted socks, stockings, panty hose or similar knitted articles of clothing of highly elastic material, comprising the steps of pulling the articles of clothing onto elongated flat forms defining a lengthwise direction of the articles of clothing, and passing said flat forms with the articles of clothing thereon in succession through different treatment stations for at least the dyeing, the fixing, and drying, the improvement comprising continuously passing said flat forms fixed, in a non-rotatable orientation with a flat side of the forms lying substantially parallel to the ground with respect to a longitudinal axis as well as a transverse axis of the flat side, through the individual treatment stations with the articles of clothing thereon and with the fibers of the articles of clothing extending in the lengthwise direction of the articles of clothing, each of said forms being separated from each other and parallel to each other.

2. The process as set forth in claim 1, wherein the fibers are synthetic fibers.

3. The process as set forth in claim 1, wherein said forms lie sidewise adjacent each other between the treatment stations.

4. The process as set forth in claim 1, wherein said forms lie one underneath the other in the treatment stations.

* * * * *